US007817948B2

(12) United States Patent
Hayakawa

(10) Patent No.: US 7,817,948 B2
(45) Date of Patent: Oct. 19, 2010

(54) IMAGE FORMING APPARATUS AND CONTROL METHOD OF IMAGE FORMING APPARATUS

(75) Inventor: Masahiro Hayakawa, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/562,314

(22) Filed: Sep. 18, 2009

(65) Prior Publication Data

US 2010/0074658 A1 Mar. 25, 2010

Related U.S. Application Data

(62) Division of application No. 11/416,127, filed on May 3, 2006, now Pat. No. 7,609,987.

(30) Foreign Application Priority Data

May 17, 2005 (JP) ..... 2005-144224

(51) Int. Cl.
*G03G 15/01* (2006.01)

(52) U.S. Cl. ..... 399/301; 399/49; 399/72; 347/116

(58) Field of Classification Search ..... 399/49, 399/72, 301; 347/116
See application file for complete search history.

(56) References Cited

U.S. PATENT DOCUMENTS

2002/0054200 A1 5/2002 Hayakawa ..... 347/116

FOREIGN PATENT DOCUMENTS

JP 2001-356542 12/2001
JP 2002-23445 1/2002

*Primary Examiner*—David P Porta
*Assistant Examiner*—Bryan P Ready
(74) *Attorney, Agent, or Firm*—Fitzpatrick, Cella, Harper & Scinto

(57) ABSTRACT

This invention enables an image forming apparatus to perform highly precise misregistration detection without causing increased downtime or increased cost. For this, the image forming apparatus according to the invention comprises a detection unit for detecting a misregistration detection pattern formed on an endless belt. The employed misregistration detection pattern includes a first pattern array formed with a misregistration detection color or a reference position color, and a second pattern array formed with a misregistration detection color or a reference position color. The misregistration detection pattern is configured in a way that the first pattern and the second pattern have different shapes, and that the color order of the first patterns in the first pattern array and the color order of the second patterns in the second pattern array are different.

5 Claims, 21 Drawing Sheets

FIG. 17

| | DRIVING ROLLER | PHOTOSENSITIVE DRUM |
|---|---|---|
| a | 0° | 0° |
| b | 0° | 240° |
| c | 0° | 120° |
| d | 180° | 90° |
| e | 180° | 330° |
| f | 180° | 210° |

FIG. 18

| | DRIVING ROLLER | PHOTOSENSITIVE DRUM |
|---|---|---|
| a | 0° | 0° |
| b | 0° | 240° |
| c | 0° | 120° |
| d | 180° | 90° |
| e | 180° | 330° |
| f | 180° | 210° |

FIG. 19

| | DRIVING ROLLER | PHOTOSENSITIVE DRUM |
|---|---|---|
| a' | 0° | 0° |
| b' | 0° | 240° |
| c' | 0° | 120° |
| d' | 180° | 210° |
| e' | 180° | 90° |
| f' | 180° | 330° |

FIG. 20

| | DRIVING ROLLER | PHOTOSENSITIVE DRUM |
|---|---|---|
| a | 0° | 0° |
| b | 80° | 240° |
| c | 160° | 120° |
| d | 180° | 288° |
| e | 260° | 168° |
| f | 340° | 48° |

FIG. 21

| | DRIVING ROLLER | PHOTOSENSITIVE DRUM |
|---|---|---|
| a | 0° | 0° |
| b | 240° | 120° |
| c | 120° | 240° |

IMAGE FORMING APPARATUS AND CONTROL METHOD OF IMAGE FORMING APPARATUS

This is a division of U.S. patent application Ser. No. 11/416,127 now U.S. Pat. No. 7,609,987, filed May 3, 2006.

FIELD OF THE INVENTION

The present invention relates to a misregistration detection technique in image forming of an image forming apparatus.

BACKGROUND OF THE INVENTION

In an image forming apparatus having a plurality of image forming units, driving unevenness occurs in the device due to factors such as lack of machine accuracy or the like, causing a misregistration (color deviation) in each color. Particularly in an apparatus having an image forming unit including a laser scanner and a photosensitive drum for each color, if a distance between the laser scanner and the photosensitive drum differs in the image forming units of respective colors, a difference is generated in a laser scanning width on the photosensitive drum, resulting in a color deviation.

In view of this, there is a technique for making various adjustments to correct the misregistration. That is, misregistration detection patterns are formed on a conveying belt, then the positions of the misregistration detection patterns are detected by an optical sensor, and the misregistration is corrected in accordance with the detected amount of misregistration.

An example of misregistration is shown in FIG. 1. Numeral 100 denotes an original image position; and 110, an image position where a misregistration is generated. Note that although numerals 110*a*, 110*b*, and 110*c* show cases where there are misregistrations in the scanning direction, the two lines are drawn apart in the conveying direction for description purposes.

Numeral 110*a* denotes a gradient gap of a scanning line, which is generated in a case where there is a gradient between a photosensitive drum and an optical unit such as a laser scanner. The gradient gap can be corrected in the arrow direction by, for instance, adjusting a position of the lens or a position of the photosensitive drum and the optical unit.

Numeral 110*b* denotes a misregistration generated by uneven scanning widths, which is caused by a different distance between the optical unit and the photosensitive drum or the like. It is often generated in a case where the optical unit is a laser scanner. The misregistration can be corrected in the arrow direction by, for instance, slightly adjusting the image frequency (if the scanning width is long, the frequency is raised) and changing the length of the scanning line.

Numeral 110*c* denotes a write-start position error in the scanning direction. Assuming that the optical unit is a laser scanner, the write-start position error can be corrected in the arrow direction by, for instance, adjusting the write-start timing at the beam detection position.

Numeral 110*d* denotes a write-start position error in the printing paper conveying direction. The write-start position error can be corrected in the arrow direction by, for instance, adjusting the write-start timing of each color upon detection of a printing paper edge.

Assume herein that misregistration detection patterns for each color of yellow (Y), magenta (M), cyan (C), and black (K) are formed on the conveying belt. The positions of the patterns are detected by a pair of optical sensors provided on both sides of the conveying belt on the downstream unit, and various adjustments are made to correct the misregistration in accordance with the detected amount of gap.

However, in detection of the misregistration detection patterns, the result is influenced by uneven driving of the photosensitive drum and uneven driving of the conveying belt driving rollers. In view of this, for instance, Japanese Patent Applications Laid-Open No. 2001-356542 and No. 2002-23445 disclose the technique for arranging the misregistration detection patterns in a way that unevenness in the cycles of the conveying belt driving rollers is averaged and cancelled.

However, in this technique of arranging the misregistration detection patterns so as to cancel the unevenness in the cycles of the photosensitive drum and the unevenness in the cycles of the conveying belt driving rollers, it is necessary to arrange the misregistration detection patterns within one periphery of the conveying belt. If the misregistration detection patterns cannot be arranged within one periphery of the conveying belt, it is necessary to perform cleaning using means to collect toner on the conveying belt in the cartridge before all the misregistration detection patterns are formed, thus requiring increased downtime.

Particularly in a small image forming apparatus, since the peripheral length of the conveying belt is short, it is difficult to arrange the conventional misregistration detection patterns within one periphery of the conveying belt. Although it may be possible to arrange the misregistration detection patterns at high density within one periphery of the conveying belt by employing special sensors having a small spot diameter, it causes an increased cost.

SUMMARY OF THE INVENTION

The present invention has been made in view of the above-described problems, and has as its object to provide a technique of realizing highly precise misregistration detection without causing increased downtime or increased cost.

In order to achieve the above object, the image forming apparatus according to the present invention has the following configuration. More specifically, an image forming apparatus comprising a plurality of image forming units adapted to sequentially form images using different colors on an endless belt or on a printing material conveyed by the endless belt, a control unit adapted to form a misregistration detection pattern on the endless belt using the image forming units, and a detection unit adapted to detect the misregistration detection pattern formed on the endless belt; wherein the misregistration detection pattern includes a first pattern array constructed with a plurality of serial first patterns, each formed with one of misregistration detection colors or a reference position color and a second pattern array constructed with a plurality of serial second patterns, each formed with one of misregistration detection colors or a reference position color; wherein the first pattern and the second pattern have different shapes and a color order of the plurality of first patterns constituting the first pattern array and a color order of the plurality of second patterns constituting the second pattern array are different.

By virtue of the present invention, it is possible to provide a technique that realizes highly precise misregistration detection without causing increased downtime or increased cost.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 17 is a table showing a correspondence of phases between a photosensitive drum and a conveying belt driving roller (premise art);

FIG. 18 is a table showing a correspondence of phases between a photosensitive drum and a conveying belt driving roller (first embodiment: C pattern);

FIG. 19 is a table showing a correspondence of phases between a photosensitive drum and a conveying belt driving roller (first embodiment: Y pattern);

FIG. 20 is a table showing a correspondence of phases between a photosensitive drum and a conveying belt driving roller (second embodiment); and FIG. 21 is a table showing a correspondence of phases between a photosensitive drum and a conveying belt driving roller (third embodiment).

DETAILED DESCRIPTION OF THE PREFERRED EMBODIMENTS

Preferred embodiments of the present invention will now be described in detail with examples in accordance with the accompanying drawings. Note that the structural elements described in the embodiments are provided as mere examples; thus the scope of the invention is not limited to these elements only.

(Premise Art)

<Apparatus Configuration>

Figure 1:
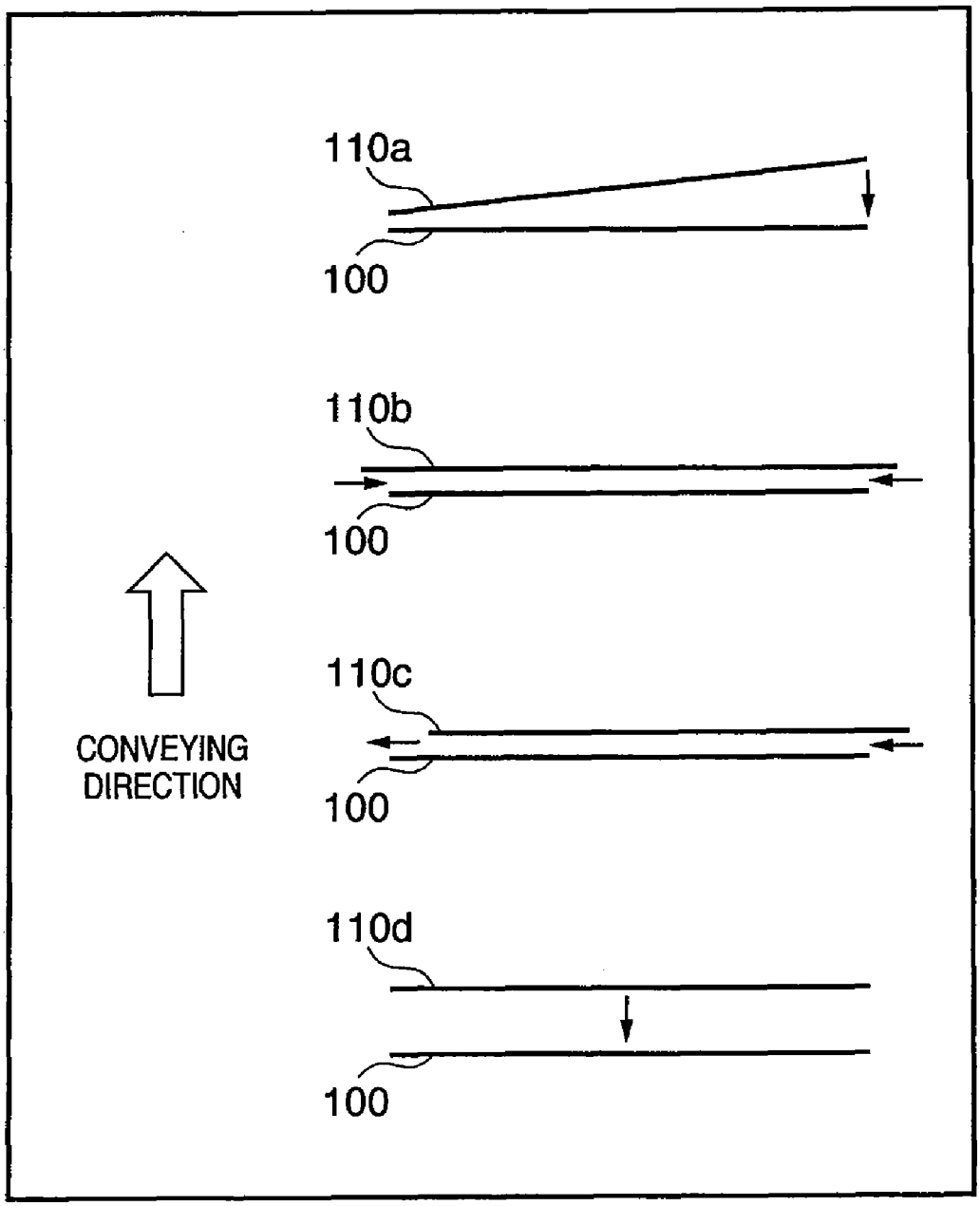
FIG. 1 is a view showing an example of misregistrations in image forming of an image forming apparatus.
Figure 2:
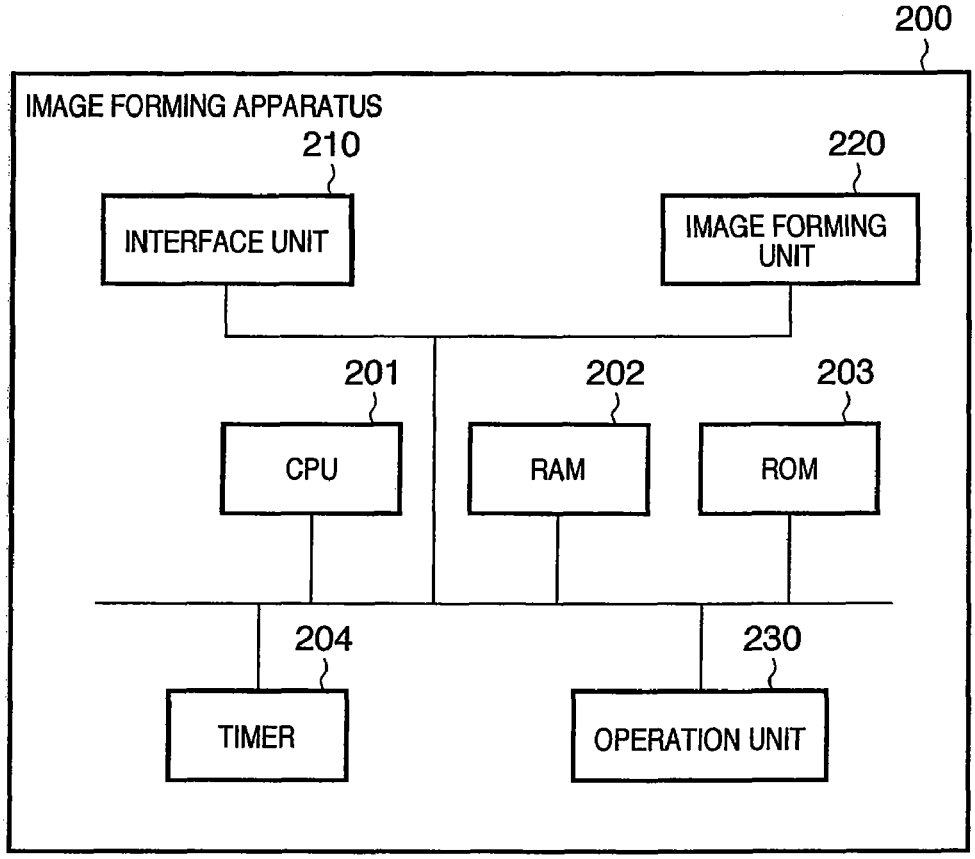
FIG. 2 is a diagram showing an internal configuration of an image forming apparatus.

FIG. 2 shows as an example an internal configuration of an image forming apparatus. An image forming apparatus 200 comprises an interface unit 210 for image data input and an image forming unit 220 for image forming. The image forming unit 220 will be described later in detail. The image forming apparatus 200 also comprises a CPU 201 which controls respective units by executing a program, RAM 202 used as a temporary data storage area or a program execution area, and ROM 203 storing a program, initial setting values, an image of a misregistration detection pattern which will be described later, and the like. The image forming apparatus 200 also comprises a timer 204 which generates timing used inside the apparatus 200.

The image forming apparatus 200 further comprises an operation unit 230 for receiving a user input. The operation unit 230 is configured with an LCD unit or the like that can be operated by a touch panel. Note that the operation unit 230 may be realized by a PC (not shown) externally connected to the image forming apparatus 200.

Figure 3:
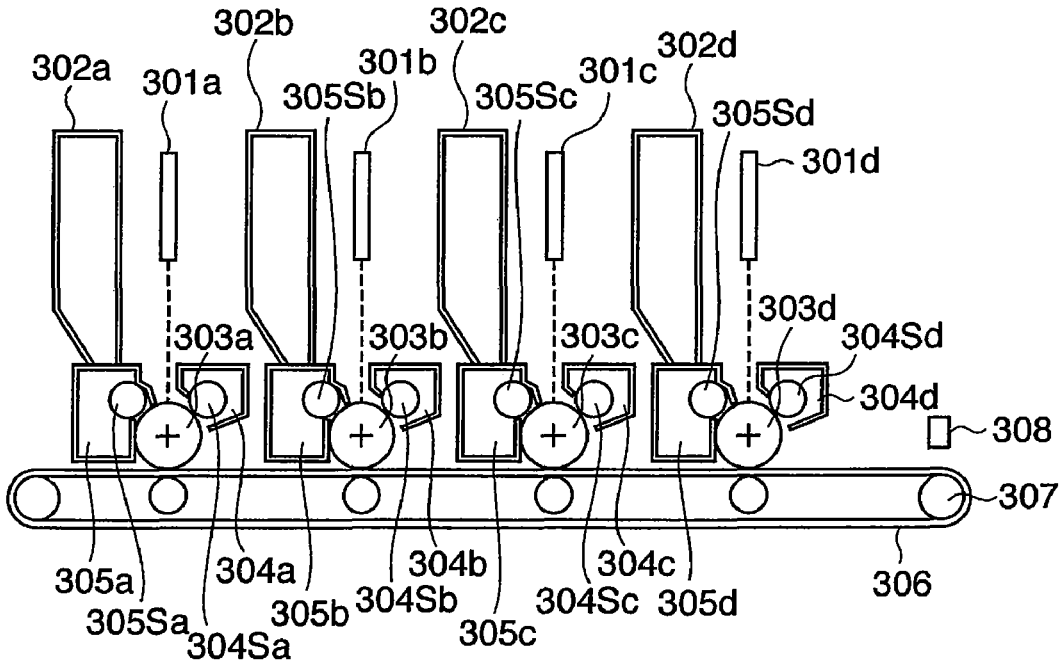
FIG. 3 is a cross-section of an image forming unit.

FIG. 3 is a cross-section of the image forming unit. Numeral 301 denotes a laser scanner which performs exposure in accordance with an image signal and forms an electrostatic latent image on a photosensitive drum (a, b, c, and d are provided respectively for Y, M, C, and K). Numeral 302 denotes a toner storage unit for storing toner to be supplied to a developer; 303, a photosensitive drum for forming an electrostatic latent image; 304, a charger for uniformly charging the surface of the photosensitive body; 304S, a charging roller; 305, a developer for attaching toner to the surface of the photosensitive body in accordance with an electrostatic latent image; 305S, a developing sleeve; 306, a conveying belt to which a toner image formed on the photosensitive body is transferred; and 307, a driving roller for driving the conveying belt. Numeral 308 denotes an optical sensor for detecting a misregistration detection pattern, which will be described later in detail.

When data is inputted from a PC to the interface unit 210, the image forming apparatus performs image forming in accordance with a printer engine system and becomes ready for printing, then paper is supplied from a paper cassette (not shown). In accordance with the paper conveying timing, image signals of respective colors are sent to each laser scanner 301. An electrostatic latent image is formed on the photosensitive drum 303, developed by the developer 305 using toner, then transferred to the conveying belt 306, and transferred to the paper. In FIG. 2, images are formed sequentially in order of Y, M, C, and K. Thereafter the paper is separated from the conveying belt 306. The toner image is fixed to the paper by heat of a fixing unit (not shown), and the paper is discharged externally. Meanwhile, the toner remained on the conveying belt 306 is collected by the cartridge by applying a bias having a reverse polarity to the bias applied upon image transferring.

<Pattern Position Detection Using Optical Sensor>

Figure 4:
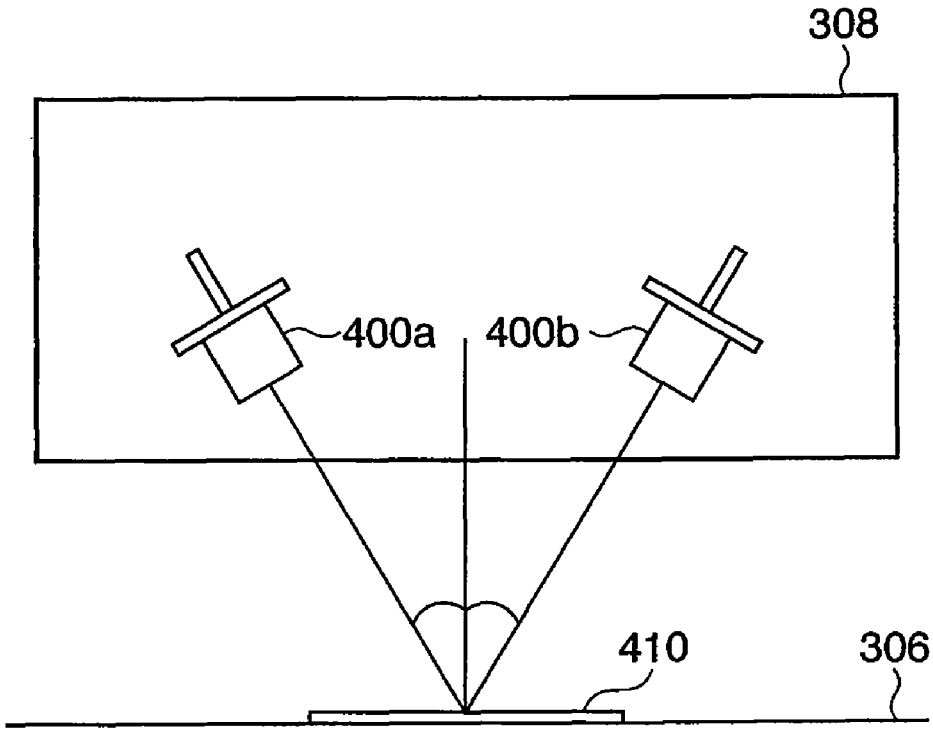
FIG. 4 is a view showing an example of a regular reflection sensor.

FIG. 4 shows an example of a regular reflection sensor. A pair of optical sensors 308 are a regular reflection sensor, comprising a light emitting element 400*a* using an LED or the like, and a photoreceptive element 400*b* using a phototransistor or the like. For instance, the light emitting element 400*a* is arranged at an angle of 30° with respect to the line perpendicular to the surface of the conveying belt 306, and emits light to a pattern (toner image) 410 on the conveying belt 306. The photoreceptive element 400*b* is arranged at a position symmetrical to the light emitting element 400*a*, and detects regular reflection light from the pattern 410. Based on a difference between the regular reflection light from the pattern 410 and the regular reflection light from the conveying belt 306, the position of the misregistration detection pattern which will be described later is detected.

<Misregistration Detection Pattern>

Figure 5:
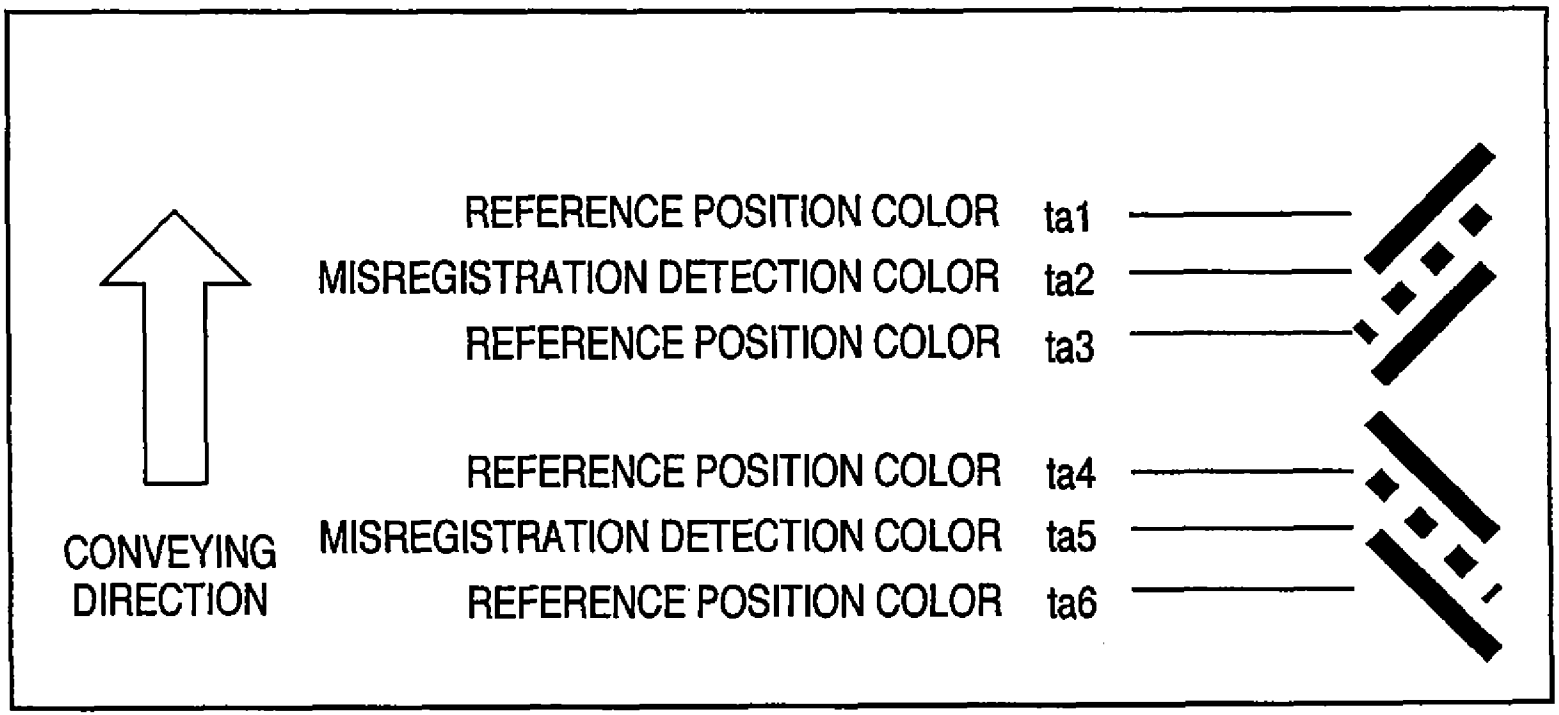
FIG. 5 is a basic pattern of a misregistration detection pattern.

FIG. 5 shows a basic pattern employed in misregistration detection. The basic pattern includes an upward oblique pattern (first pattern) and a downward oblique pattern (second pattern). Each pattern has a reference position color (K is used herein) (hereinafter referred to as a reference color) which is used as a reference position, and a misregistration detection color (C, M, and Y are used herein) (hereinafter referred to as a detection color). With respect to the detection color of the basic pattern, the amount of misregistration δem1 [mm] in the conveying direction and the amount of misregistration δes1 [mm] in the scanning direction are obtained by the following equations, assuming that the belt conveying speed is Vbelt [mm/s]:

$$\delta em1 = V\text{belt}\times[\{ta2-(ta1+ta3)/2\}+\{ta5-(ta4+ta6)/2\}]/2 \quad (1)$$

$$\delta es1 = V\text{belt}\times[\{ta2-(ta1+ta3)/2\}-\{ta5-(ta4+ta6)/2\}]/2 \quad (2)$$

Herein, ta1 to ta6 respectively indicate the detection timing (time) of the detection color and the reference color having the same reference numerals in the drawing.

Figure 6:
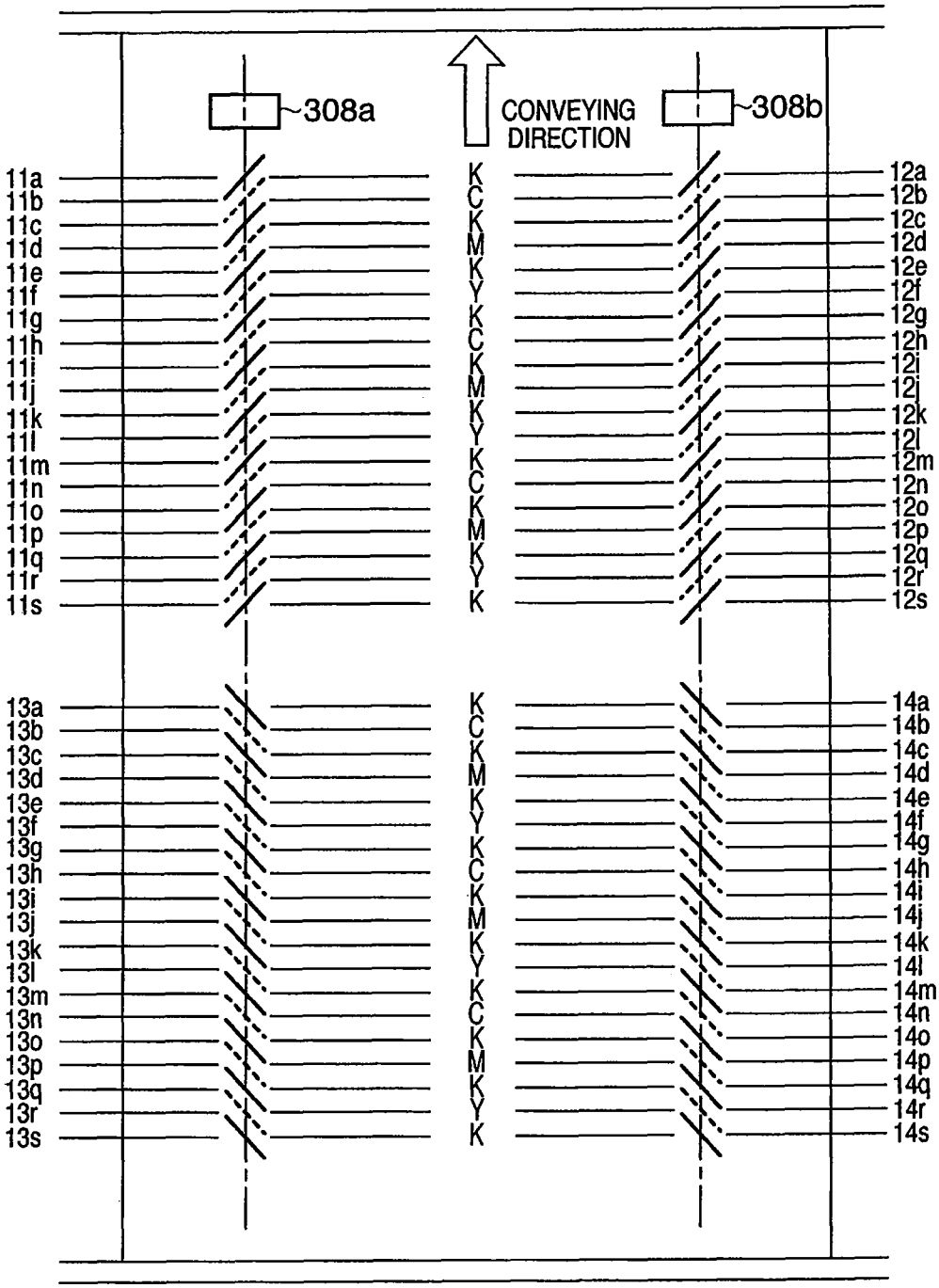
FIG. 6 is a view showing an example of a misregistration detection pattern formed on a conveying belt (premise art)

FIG. 6 shows a misregistration detection pattern formed on the conveying belt. Numerals 11 to 14 denote patterns for detecting the amount of misregistration in the printing paper conveying direction and the scanning direction. This is formed by serially arranging the basic pattern shown in FIG. 5. Note that the suffix K, C, M, and Y respectively mean images of black, cyan, magenta, and yellow.

Assume that the reference letters are defined as follows:

Distance between patterns having an identical detection color and an identical shape (a combination of first patterns or a combination of second patterns): Lp1

Distance between patterns having an identical detection color and different shapes (a combination of first and second patterns): Lp2

The number of patterns: N (N is an odd number)

Peripheral length of photosensitive drum: La

Peripheral length of conveying belt driving roller: Lb

The arranging position of the misregistration detection pattern is determined so as to satisfy the following equations:

$$Lp1\times N = n\times La$$

$$Lp2 = (N/2)\times Lb$$

Note that n is a natural number. The amount of color gap calculated by equations (1) and (2) is what is obtained after the driving unevenness caused by an influence of the photosensitive drum 303 and the driving unevenness caused by an influence of the driving roller 307 are averaged and cancelled.

Note in FIG. 6, the pattern arrays indicated by reference numerals 11 and 13 respectively correspond to the first pattern array and the second pattern array in the claims.

Hereinafter, in the image forming apparatus, assume that the peripheral length of the driving roller 307 of the conveying belt 306 is 40 mm, the peripheral length of the photosensitive drum 303 is 48 mm, and the peripheral length of the conveying belt 306 is 600 mm. The assumed driving unevenness includes driving unevenness caused by the driving roller 307 and driving unevenness caused by the photosensitive drum 303. Assume that the maximum value of the driving unevenness caused by the conveying belt driving roller is 60 μm, and the maximum value of the driving unevenness caused by the photosensitive drum is 40 μm. Further, assume that the image forming apparatus is capable of forming images at resolution of 600 dpi (42.3 μm per dot).

Herein, the patterns of the reference color having an identical shape (e.g., 11*a* to 11*c* in FIG. 6) are arranged at intervals of 26.67 mm (pattern's sectional width in the conveying direction and scanning direction: 150 dots, pattern space: 165 dots, pattern width in the scanning direction: 300 dots). Since the space between the patterns of a detection color having an identical shape is 80 mm (=26.67 mm×3), three sets of patterns can be arranged at positions whose phases are shifted by 5/3 cycles of the peripheral length 48 mm of the photosensitive drum 303. As a result, the driving unevenness of the photosensitive drum 303 is averaged and cancelled.

Moreover, the space between the patterns of an identical detection color having different shapes (e.g., 11*b* to 13*b* in FIG. 6) is set in 300 mm. Since the space between the patterns of an identical detection color having different shapes is 300 mm (=40 mm×7.5), two sets of patterns can be arranged at positions whose phases are shifted by 7.5 cycles of the peripheral length 40 mm of the driving roller 307. As a result, the driving unevenness of the driving roller 307 is averaged and cancelled.

Figure 7:
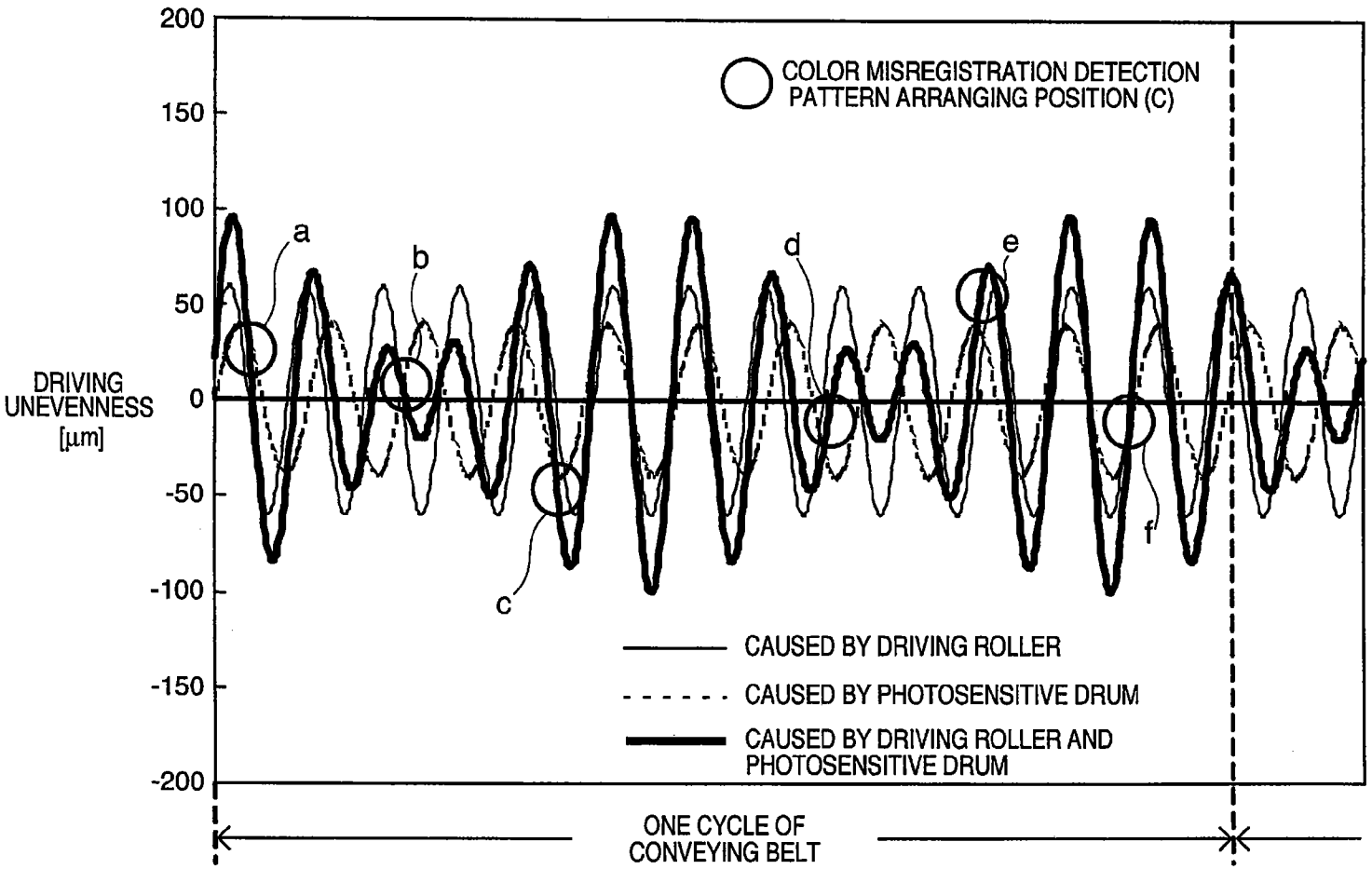
FIG. 7 is a graph showing an arrangement relation between a C pattern and driving unevenness (premise art)

FIG. 7 shows an arrangement relation between a C pattern and driving unevenness. The curved line represented by a thick solid line indicates the total amount of driving unevenness caused by the driving roller 307 and the photosensitive drum 303. The reference letters a, b, and c in the drawing are positions corresponding to a cyan (C) pattern having the upward shape (first pattern), and letters d, e, and f are positions corresponding to a C pattern having the downward shape (second pattern). Assuming that the positions of the conveying belt driving roller and the photosensitive drum in the pattern a are the reference positions (phase 0°), the phases of the conveying belt driving roller and the photosensitive drum at the positions of patterns b, c, d, e, and f are shown in FIG. 17.

The total amount of driving unevenness L1 received by the set of C patterns (6 points) is calculated as follows:

$$L1 = 18.17-5.53-50.06-13.24+51.87-1.21 = 0.0\ [\mu m]$$

In other words, it is clear that the influence of the driving unevenness caused by the photosensitive drum 303 and the driving roller 307 is averaged and cancelled. Also in the case of M and Y patterns, the influence of driving unevenness caused by the photosensitive drum 303 and the driving roller 307 is averaged and cancelled. Note that the total length Ly of the misregistration detection pattern in this case is as follows:

$$Ly = (150\times19+165\times18+300)/600\times25.4\times2+\{300-(150\times19+165\times18+300)/600\times25.4\}+165/600\times25.4 = 566.1\ [mm]$$

Note that the third term (165/600×25.4) is an allowance to prevent overlaps of the front-end patterns (11*a*, 12*a*) and the rear-end patterns (13*s*, 14*s*). In other words, it is clear that the conveying belt 306 must be at least 566.1 mm or more. Therefore, in a case of a small image forming apparatus where the peripheral length of the conveying belt 306 is smaller than this length, this misregistration detection pattern is not applicable.

<Operation Flow of Misregistration Detection>

Figure 8:
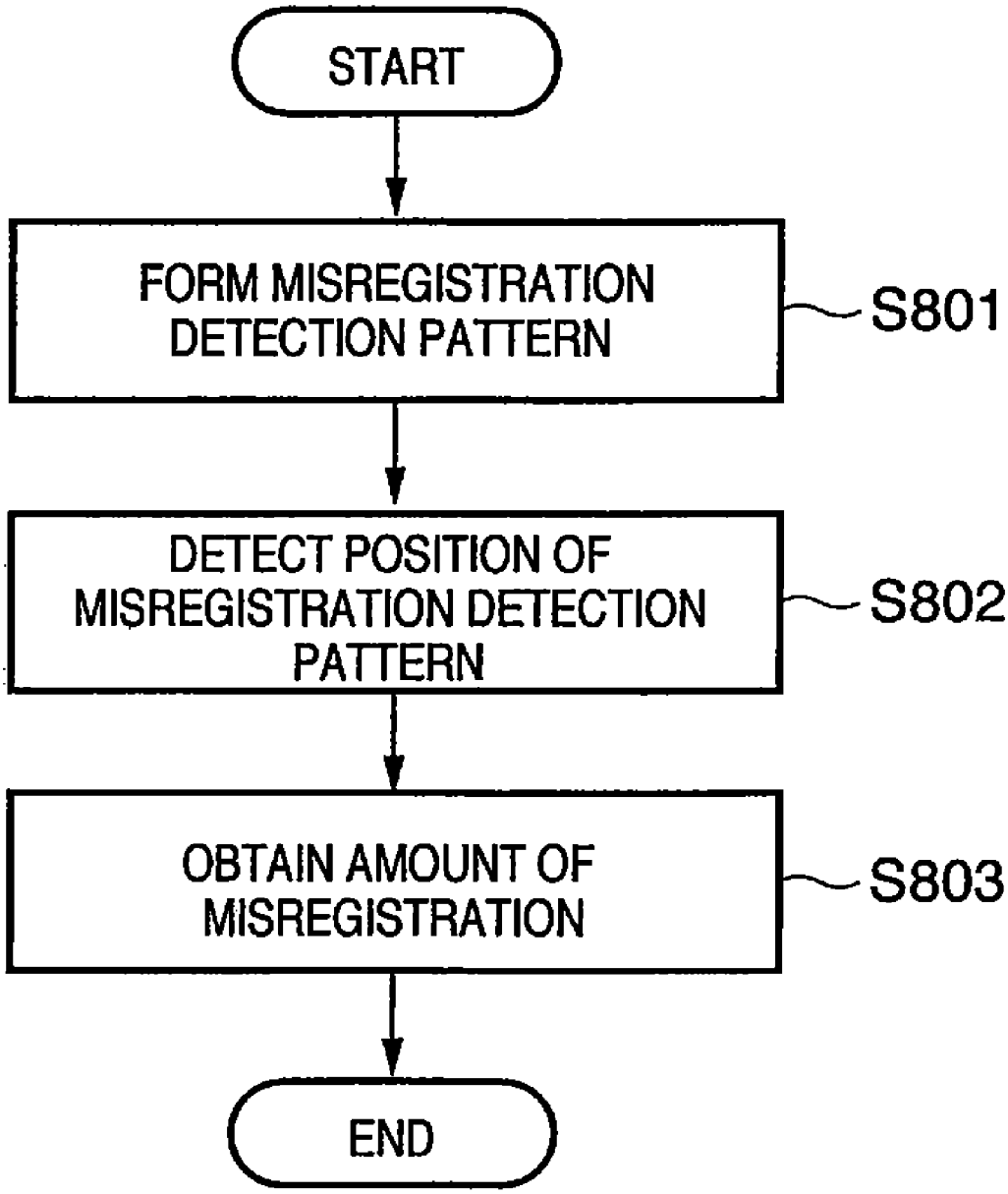
FIG. 8 is a flowchart describing misregistration detection (premise art)

FIG. 8 shows an example of an operation flowchart of misregistration detection. Note that the misregistration detection is performed at the timing independent of normal image forming, for instance, performed when the power is turned on. The following operation is executed by reading a program stored in the ROM 203 by the CPU 201.

In step S801, a misregistration detection pattern such as that shown in FIG. 6 is formed on the conveying belt 306.

In step S802, the misregistration detection pattern formed on the conveying belt 306 in step S801 is detected by the pair of optical sensors 308 (308*a* and 308*b*) provided on both sides of the conveying belt 306. In this stage, the detected result is stored in the RAM 202 along with the timing generated by the timer 204.

In step S803, the amount of misregistration is obtained for each color (C, M, Y, and K) based on the detected timing stored in the RAM 202 in step S802.

Based on the amount of misregistration obtained in the foregoing manner, various adjustments are made, and a high-quality image can be formed.

First Embodiment

The first embodiment of an image forming apparatus according to the present invention is described below using, as an example, a case of employing a misregistration detection pattern where the order of detection colors is changed among the patterns having different shapes. Note that since the apparatus configuration and the operation flow are similar to that of the above-described premise art, description thereof is omitted.

<Misregistration Detection Pattern According to First Embodiment>

Figure 9:
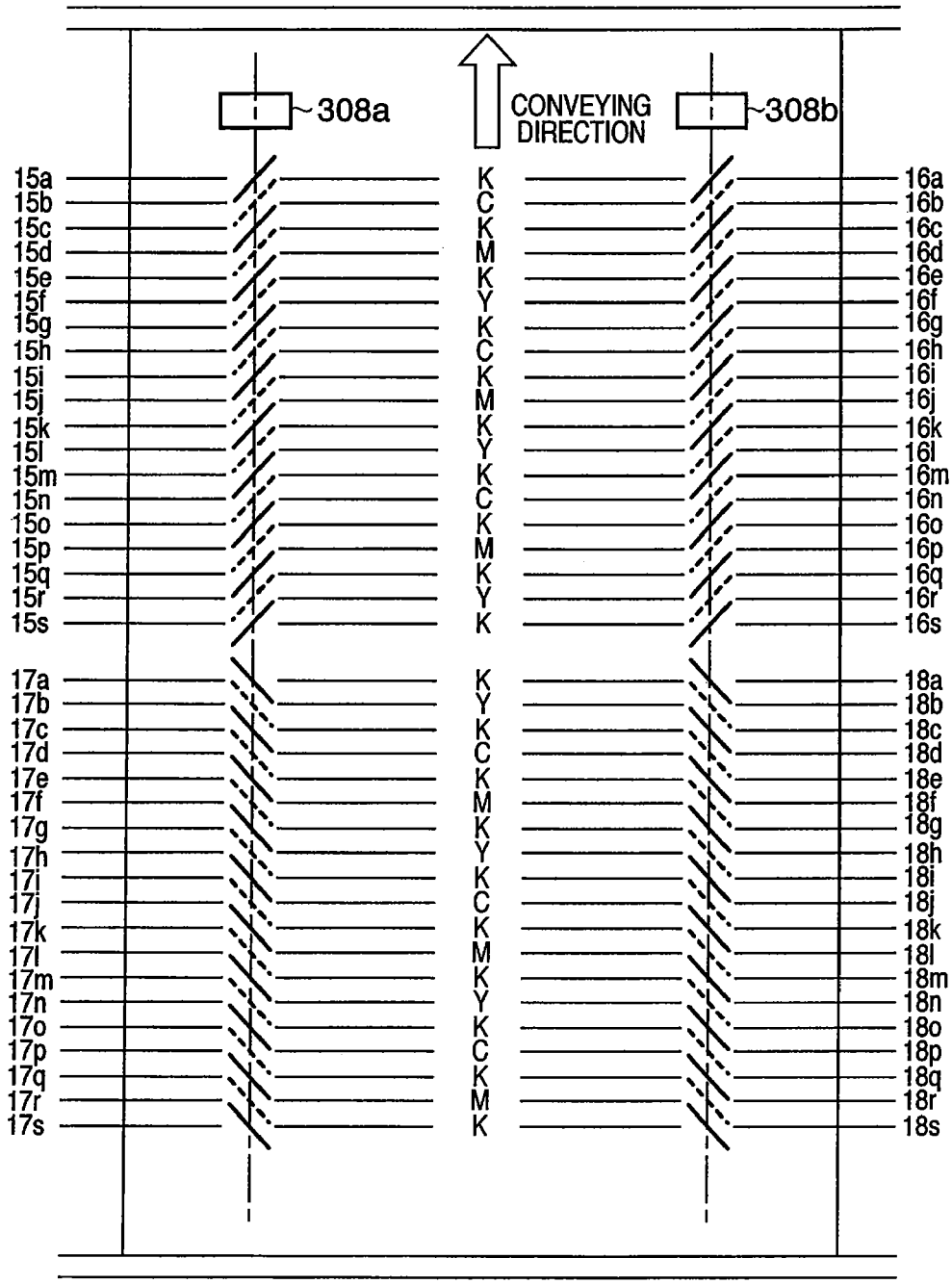
FIG. 9 is a view showing an example of a misregistration detection pattern formed on a conveying belt of an image forming apparatus according to the first embodiment.

FIG. 9 shows a misregistration detection pattern formed on the conveying belt according to the first embodiment.

The shape of the basic pattern used in misregistration detection is similar to that of the above-described premise art (FIG. 5). The arranging position of the misregistration detection pattern is also the same.

More specifically, assume that the reference letters are defined as follows:

Distance between patterns having an identical detection color and an identical shape (a combination of first patterns or a combination of second patterns): Lp1

Distance between patterns having an identical detection color and different shapes (a combination of first and second patterns): Lp2

The number of patterns: N (N is an odd number)

Peripheral length of photosensitive drum: La

Peripheral length of conveying belt driving roller: Lb

The arranging position of the misregistration detection pattern is determined so as to satisfy the following equations:

$$Lp1 \times N = n \times La$$

$$Lp2 = (N/2) \times Lb$$

Note that n is a natural number. The amount of color gap calculated by equations (1) and (2) is what is obtained after the driving unevenness caused by an influence of the photosensitive drum 303 and the driving unevenness caused by an influence of the driving roller 307 are averaged and cancelled.

Note that the color order of plural first patterns constituting the first pattern array is different from the color order of plural second patterns constituting the second pattern array.

In the image forming apparatus according to the first embodiment, assume that the peripheral length of the driving roller 307 of the conveying belt 306 is 40 mm, the peripheral length of the photosensitive drum 303 is 48 mm, and the peripheral length of the conveying belt 306 is 550 mm. The assumed driving unevenness includes driving unevenness caused by the driving roller 307 and driving unevenness caused by the photosensitive drum 303. Assume that the maximum value of the driving unevenness caused by the driving roller 307 is 60 μm, and the maximum value of the driving unevenness caused by the photosensitive drum 303 is 40 μm. Further, assume that the image forming apparatus is capable of forming images at resolution of 600 dpi (42.3 μm per dot).

Herein, the patterns of the reference color having an identical shape (e.g., 15*a* to 15*c* in FIG. 9) are arranged at intervals of 26.67 mm (pattern width in the conveying direction: 150 dots, pattern space: 165 dots, pattern width in the scanning direction: 500 dots). Since the space between the patterns of a detection color having an identical shape is 80 mm (=26.67 mm×3), three sets of patterns can be arranged at positions whose phases are shifted by 5/3 cycles of the peripheral length 48 mm of the photosensitive drum 303. As a result, the driving unevenness of the photosensitive drum 303 is averaged and cancelled.

Moreover, the space between the patterns of an identical detection color having different shapes is set in 300 mm with respect to C and M (e.g., 15*b* to 17*d* and 15*d* to 17*f* in FIG. 9), and set in 260 mm with respect to Y (e.g., 15*f* to 17*b* in FIG. 9).

Since the space between the patterns of an identical detection color having different shapes is 300 mm (=40 mm×7.5) with respect to C and M, two sets of patterns can be arranged at positions whose phases are shifted by 7.5 cycles of the peripheral length 40 mm of the driving roller 307. As a result, the driving unevenness of the driving roller 307 is averaged and cancelled. Also with respect to Y, since the space between the patterns of an identical detection color having different shapes is 260 mm (=40 mm×6.5), two sets of patterns can be arranged at positions whose phases are shifted by 6.5 cycles of the peripheral length 40 mm of the driving roller 307. As a result, the driving unevenness of the driving roller 307 is averaged and cancelled.

Figure 10:
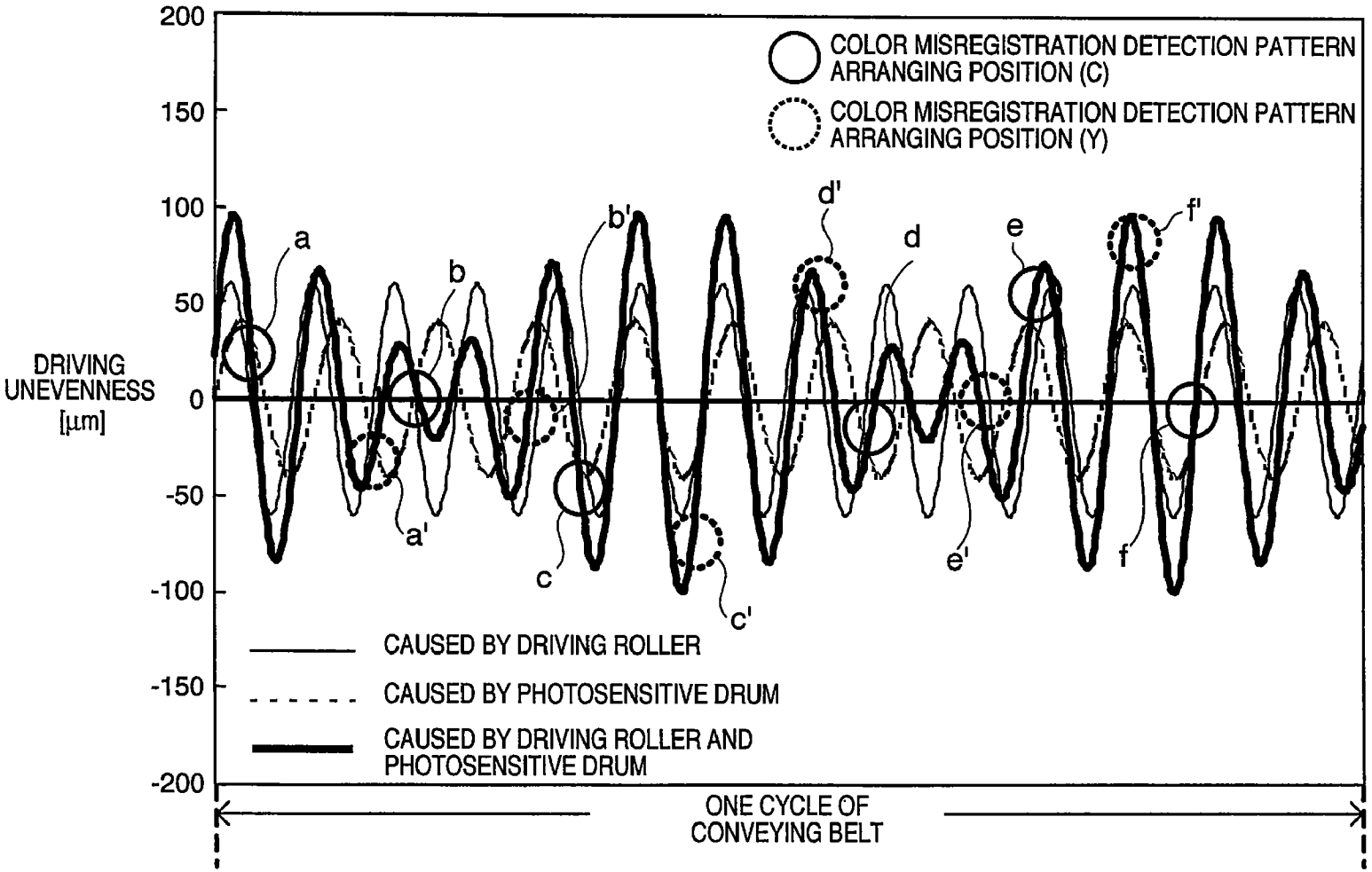
FIG. 10 is a graph showing an arrangement relation between C or Y pattern and driving unevenness of the image forming apparatus according to the first embodiment.

FIG. 10 shows an arrangement relation between the C or Y pattern and driving unevenness. The curved line represented by a thick solid line indicates the total amount of driving unevenness caused by the driving roller 307 and the photosensitive drum 303. The circle mark in solid lines indicates driving unevenness at the position corresponding to the C pattern, and the circle mark in broken lines indicates driving unevenness at the position corresponding to the Y pattern.

The reference letters a, b, and c in the drawing are positions corresponding to the C pattern having the upward shape (first pattern), and letters d, e, and f are positions corresponding to the C pattern having the downward shape (second pattern). Assuming that the positions of the conveying belt driving roller and the photosensitive drum in the pattern a are the reference positions (phase 0°), the phases of the conveying belt driving roller and the photosensitive drum at the positions of patterns b, c, d, e, and f are shown in FIG. 18. The total amount of driving unevenness L2 received by the set of C patterns (6 points) is calculated as follows:

$$L2 = 18.17 - 5.53 - 50.06 - 13.24 + 51.87 - 1.21 = 0.0\ [\mu m]$$

Note that the same description is applicable also to the M pattern.

Meanwhile, the reference letters a', b', and c' in the drawing are positions corresponding to the yellow (Y) pattern having the upward shape (first pattern), and letters d', e', and f' are positions corresponding to the Y pattern having the downward shape (second pattern). Assuming that the positions of the conveying belt driving roller and the photosensitive drum in the pattern a' are the reference positions (phase 0°), the phases of the conveying belt driving roller and the photosensitive drum at the positions of patterns b', c', d', e', and f' are shown in FIG. 19. The total amount of driving unevenness L3 received by the set of Y patterns (6 points) is calculated as follows:

$$L3=-37.64-13.95-82.18+58.27+5.2+70.30=0.0\ [\mu m]$$

In other words, with respect to each of the colors C, M, and Y, it is clear that the driving unevenness caused by the photosensitive drum 303 and the driving roller 307 is averaged and cancelled.

Note that the total length Lw of the misregistration detection pattern in this case is as follows:

$$Lw=(150\times19+165\times18+300)/600\times25.4\times2+\{300-(150\times21+165\times20+300)/600\times25.4\}+165/600\times25.4=539.45\ [mm]$$

Note that the third term (165/600×25.4) is an allowance to prevent overlaps of the front-end patterns (15*a*, 16*a*) and the rear-end patterns (17*s*, 18*s*). In other words, it is clear that the total length of the detection pattern is shorter than the total length 566.1 mm of the detection pattern described in the premise art. Therefore, the applicable range of this misregistration detection pattern can be extended to a small image forming apparatus where the peripheral length of the conveying belt 306 is short.

Conversely to the above description, the arranging position of the color gap detection pattern may be determined so as to satisfy the following equations:

$$Lp2\times N=n\times La$$

$$Lp1=(N/2)\times Lb$$

Further, for an endless belt, an intermediate transfer belt (not shown) may be used in addition to the conveying belt 306 which conveys paper (printing material). In this case, to perform normal image forming, an image formed by the image forming unit 220 is sequentially transferred (primary transfer) on top of each other to the intermediate transfer belt, and then transferred (secondary transfer) all at once to a printing material conveyed by the printing material conveying means. Meanwhile, in a case of misregistration detection, a misregistration detection pattern formed by the image forming unit 220 is primarily transferred to the intermediate transfer belt, and detected by a sensor on the intermediate transfer belt.

As described above, according to the present embodiment, it is possible to realize highly precise misregistration detection employing a shorter misregistration detection pattern, while suppressing increased downtime and cost.

Second Embodiment

The second embodiment of an image forming apparatus according to the present invention is described below using, as an example, a case of employing a misregistration detection pattern where the order of detection colors is changed among the patterns having an identical shape. Note that since the apparatus configuration and the operation flow are similar to that of the above-described premise art, description thereof is omitted.

In the image forming apparatus according to the present embodiment, assume that the peripheral length of the driving roller 307 of the conveying belt 306 is 48 mm, and the peripheral length of the photosensitive drum 303 is 40 mm. The assumed driving unevenness includes driving unevenness caused by the driving roller 307 and driving unevenness caused by the photosensitive drum 303. Assume that the maximum value of the driving unevenness caused by the driving roller 307 is 60 μm, and the maximum value of the driving unevenness caused by the photosensitive drum 303 is 40 μm. Further, assume that the image forming apparatus is capable of forming images at resolution of 600 dpi (42.3 μm per dot).

In the conventional misregistration detection pattern (FIG. 6), by arranging the patterns of the reference color having an identical shape (e.g., 15*a* to 15*c* in FIG. 9) at intervals of 27.43 mm (pattern width in the conveying direction: 150 dots, pattern space: 174 dots, pattern width in the scanning direction: 300 dots), the driving unevenness of the photosensitive drum 303 is averaged and cancelled.

Moreover, the space between the patterns of an identical detection color having different shapes (e.g., space between 11*b* and 13*b* in FIG. 6) is set in 312 mm.

Since the space between the patterns of an identical detection color having different shapes is 312 mm (=48 mm×6.5), two sets of patterns can be arranged at positions whose phases are shifted by 6.5 cycles of the peripheral length 40 mm of the driving roller 307. As a result, the driving unevenness of the driving roller 307 is averaged and cancelled.

The total length Lz of the misregistration detection pattern in this case is as follows:

$$Lz=(150\times19+174\times18+300)/600\times25.4\times2+\{312-(150\times19+174\times18+300)/600\times25.4\}+165/600\times25.4=584.923\ [mm]$$

Note that the third term (165/600×25.4) is an allowance to prevent overlaps of the front-end patterns (11*a*, 12*a*) and the rear-end patterns (13*s*, 14*s*).

<Misregistration Detection Pattern According to Second Embodiment>

Figure 11:
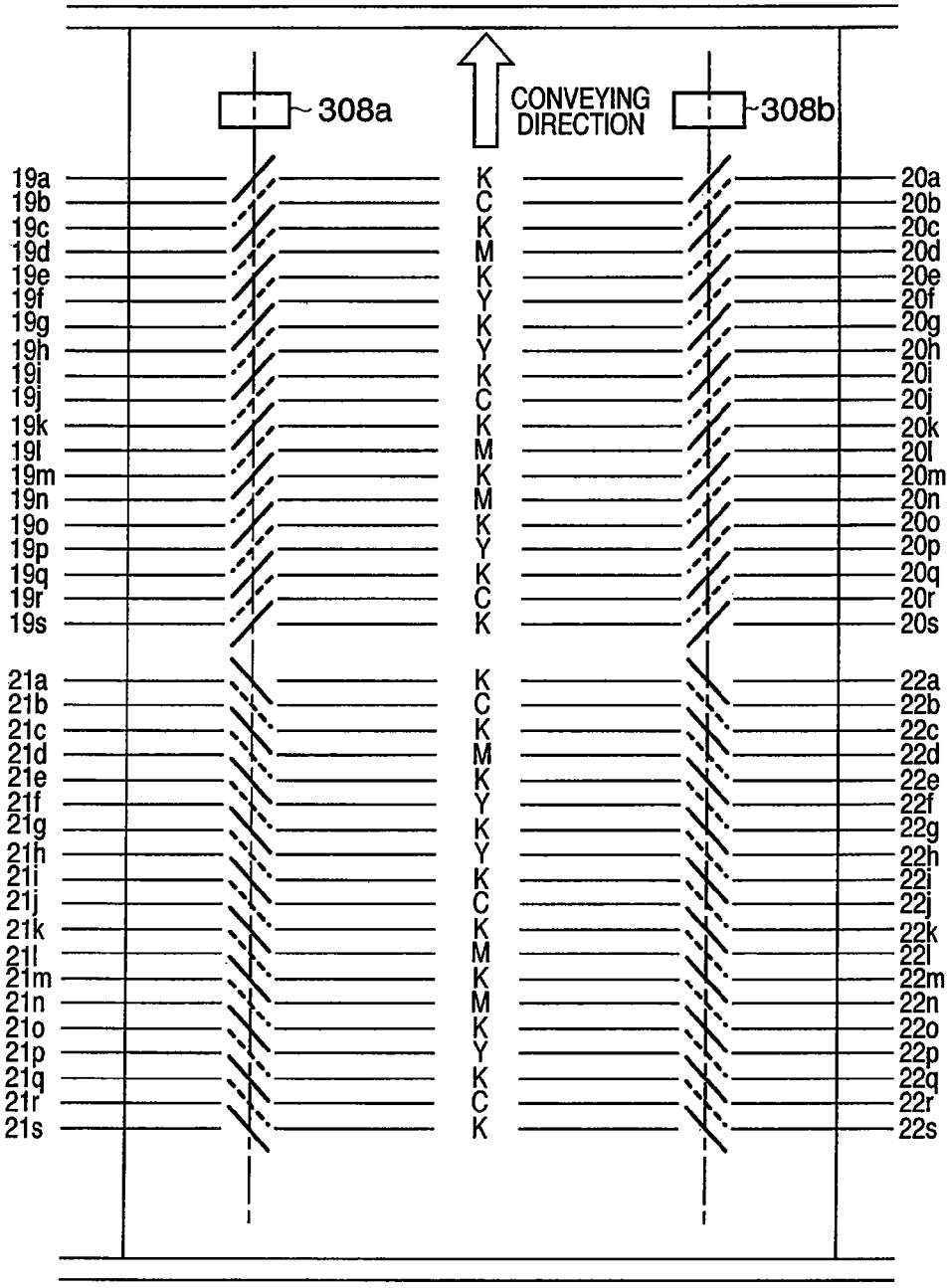
FIG. 11 is a view showing a misregistration detection pattern formed on a conveying belt of an image forming apparatus according to the second embodiment.

FIG. 11 shows a misregistration detection pattern formed on the conveying belt according to the second embodiment.

The basic pattern used in misregistration detection is similar to that of the above-described premise art (FIG. 5). The arranging position of the misregistration detection pattern is also the same.

More specifically, assume that the reference letters are defined as follows:

Distance between patterns having an identical detection color and an identical shape (a combination of first patterns or a combination of second patterns): Lp1

Distance between patterns having an identical detection color and different shapes (a combination of first and second patterns): Lp2

The number of patterns: N (N is an odd number)

Peripheral length of photosensitive drum: La

Peripheral length of conveying belt driving roller: Lb

The arranging position of the misregistration detection pattern is determined so as to satisfy the following equations:

$$Lp1\times N=n\times La$$

$$Lp2=(N/2)\times Lb$$

Note that n is a natural number. The amount of color gap calculated by equations (1) and (2) is what is obtained after the driving unevenness caused by an influence of the photosensitive drum 303 and the driving unevenness caused by an influence of the driving roller 307 are averaged and cancelled.

Note that the misregistration detection pattern is different from the pattern of the premise art in the point that the order of detection colors is changed among the patterns having an identical shape.

Herein, the patterns of the reference color having an identical shape (e.g., 19*a* to 19*c* in FIG. 11) are arranged at intervals of 26.67 mm (pattern width in the conveying direction: 150 dots, pattern space: 165 dots, pattern width in the scanning direction: 300 dots).

Furthermore, the patterns of a detection color having an identical shape with C are arranged at the positions of 106.67 mm (=40 mm×8/3) and 213.33 mm (=40 mm×16/3) with 19*b* as a reference. The patterns of a detection color having an identical shape with M are arranged at the positions of 106.67 mm (=40 mm×8/3) and 133.33 mm (=40 mm×10/3) with 19*d* as a reference. The patterns of a detection color having an identical shape with Y are arranged at the positions of 26.67 mm (=40 mm×2/3) and 133.33 mm (=40 mm×10/3) with 19*f* as a reference. Therefore, three sets of patterns can be arranged at positions whose phases are shifted by 1/3×n cycles (n is a natural number) of the peripheral length 40 mm of the photosensitive drum 303. As a result, the driving unevenness of the photosensitive drum 303 is averaged and cancelled.

Moreover, the space between the patterns of an identical detection color having different shapes (e.g., 19*b* to 21*b* in FIG. 11) is set in 312 mm (=48 mm×6.5).

Since the space between the patterns of an identical detection color having different shapes is 312 mm (=48 mm×6.5), two sets of patterns can be arranged at positions whose phases are shifted by 6.5 cycles of the peripheral length 48 mm of the driving roller 307. As a result, the driving unevenness of the driving roller 307 is averaged and cancelled.

Figure 12:
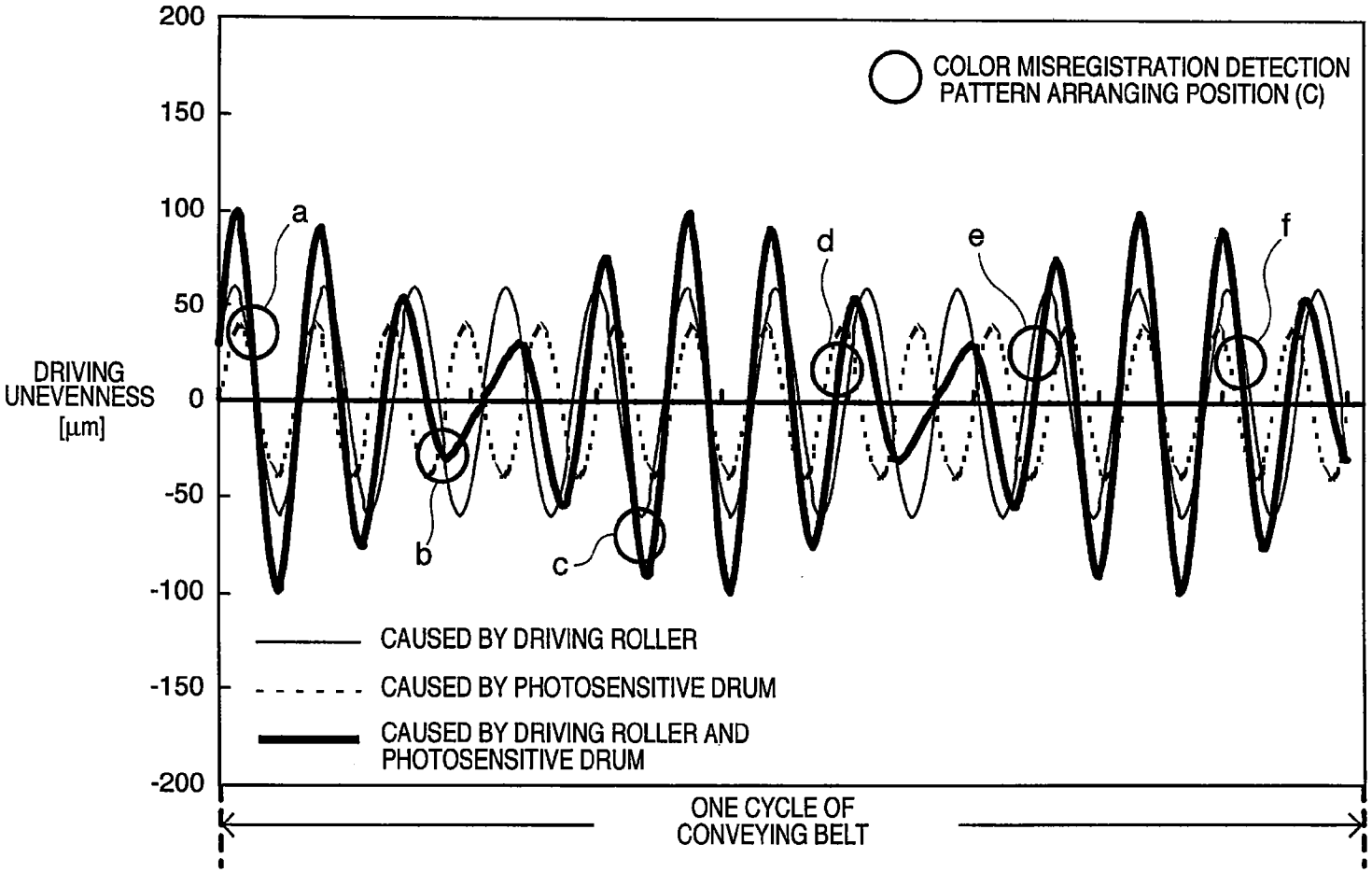
FIG. 12 is a graph showing an arrangement relation between a C pattern and driving unevenness of the image forming apparatus according to the second embodiment.

FIG. 12 shows an arrangement relation between the C pattern and driving unevenness according to the second embodiment. The curved line represented by a thick solid line indicates the total amount of driving unevenness caused by the driving roller 307 and the photosensitive drum 303. The reference letters a, b, and c in the drawing are positions corresponding to the C pattern having the upward shape (first pattern), and letters d, e, and f are positions corresponding to the C pattern having the downward shape (second pattern). Assuming that the positions of the conveying belt driving roller and the photosensitive drum in the pattern a are the reference positions (phase 0°, the phases of the conveying belt driving roller and the photosensitive drum at the positions of patterns b, c, d, e, and f are shown in FIG. 20. The total amount of driving unevenness L4 received by the set of C patterns (6 points) is calculated as follows:

$$L4=36.79-28.45-78.35+19.26+28.45+22.30=0.0\ [\mu m]$$

In other words, it is clear that the driving unevenness caused by the photosensitive drum 303 and the driving roller 307 is averaged and cancelled. Also in the case of M and Y patterns, the same description can be applied.

Note that the total length Lx of the misregistration detection pattern in this case is as follows:

$$Lx=(150\times19+165\times18+300)/600\times25.4\times2+\{312-(150\times19+165\times18+300)/600\times25.4\}+165/600\times25.4=578.065\ [mm]$$

Note that the third term (165/600×25.4) is an allowance to prevent overlaps of the front-end patterns (19*a*, 20*a*) and the rear-end patterns (21*s*, 22*s*). In other words, it is clear that the total length of the detection pattern is shorter than the total length 584.923 mm of the detection pattern using the premise art. Therefore, the applicable range of this misregistration detection pattern can be extended to a small image forming apparatus where the peripheral length of the conveying belt 306 is short.

Conversely to the above description, the arranging position of the color gap detection pattern may be determined so as to satisfy the following equations:

$$Lp2\times N=n\times La$$

$$Lp1=(N/2)\times Lb$$

As described above, according to the present embodiment, it is possible to realize highly precise misregistration detection employing a shorter misregistration detection pattern, while suppressing increased downtime and cost.

Third Embodiment

The third embodiment of an image forming apparatus according to the present invention is described below using, as an example, a case of employing a mountain-shaped pattern as a basic pattern used in misregistration detection. Note that since the apparatus configuration and the operation flow are substantially identical to that of the above-described premise art, description thereof is omitted.

In the image forming apparatus of the present embodiment, assume that the peripheral length of the driving roller 307 of the conveying belt 306 is 60 mm, and the peripheral length of the photosensitive drum 303 is 30 mm. The assumed driving unevenness includes driving unevenness caused by the driving roller 307 and driving unevenness caused by the photosensitive drum 303. Assume that the maximum value of the driving unevenness caused by the driving roller 307 is 60 μm, and the maximum value of the driving unevenness caused by the photosensitive drum 303 is 40 μm. Further, assume that the image forming apparatus is capable of forming images at resolution of 600 dpi (42.3 μm per dot).

Figure 13:
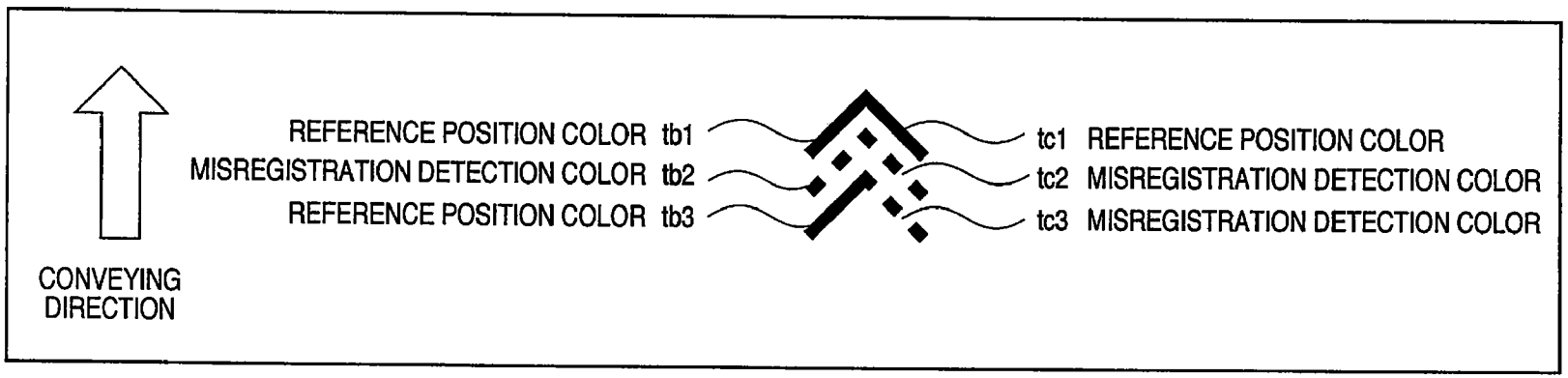
FIG. 13 is a basic pattern employed in misregistration detection of an image forming apparatus according to the third embodiment.

FIG. 13 shows a basic pattern employed in misregistration detection according to the third embodiment. The basic pattern is an upside-down V-formation pattern, configured with an upward oblique pattern and a downward oblique pattern. The pattern has a reference color (K is used herein) which is used as a reference position, and a misregistration detection color (C, M, and Y are used herein) (hereinafter referred to as a detection color). With respect to the detection color of the basic pattern, the amount of misregistration δem2 [mm] in the conveying direction and the amount of misregistration δes2 [mm] in the scanning direction are obtained by the following equations, assuming that the belt conveying speed is Vbelt [mm/s]:

$$\delta es2=V\text{belt}\times\{(tb2-tb1)-(tc2-tc1)\}/2 \quad (3)$$

$$\delta em2=V\text{belt}\times\{(tc3-tc2)-(tb3-tb2)\}-\delta es2 \quad (4)$$

Herein, tb1 to tb3 and tc1 to tc3 respectively indicate the detection timing (time) of the detection color and the reference color having the same reference numerals in the drawing.

Figure 14:
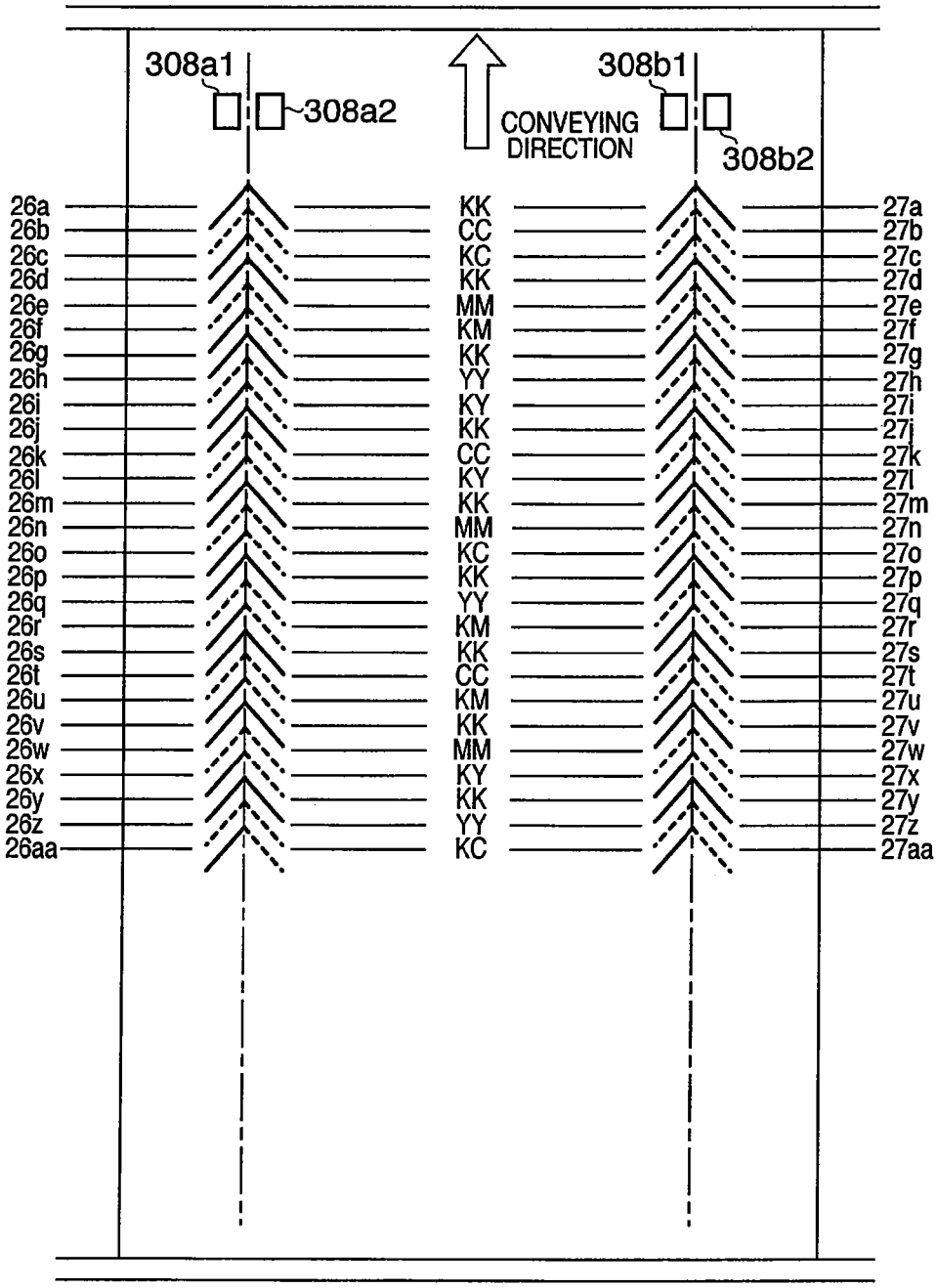
FIG. 14 is a view showing a misregistration detection pattern formed on a conveying belt of the image forming apparatus according to the third embodiment.

FIG. 14 shows a misregistration detection pattern formed on the conveying belt, according to the third embodiment. Note that numeral 308 (308*a*1, 308*a*2, 308*b*1, and 308*b*2) denotes an optical sensor for misregistration detection.

Assume that the reference letters are defined as follows:

Distance between basic patterns: Lp1

Distance between patterns having an identical detection color: Lp2

The number of patterns: N (N is an odd number)

Peripheral length of photosensitive drum or peripheral length of conveying belt driving roller: La The arranging position of the misregistration detection pattern is determined so as to satisfy the following equations:

$$Lp1\times N=n\times La$$

$$Lp2=m\times Lp1$$

Note that n and m are natural numbers. The amount of color gap calculated by equations (3) and (4) is what is obtained after the driving unevenness caused by an influence of the photosensitive drum 303 and the driving unevenness caused by an influence of the driving roller 307 are averaged and cancelled.

Herein, the basic patterns (=reference color patterns) (e.g., 26*a* to 26*d* in FIG. 14) are arranged at intervals of 31.07 mm (pattern width in the conveying direction: 150 dots, pattern space: 217 dots, pattern width in the scanning direction 300 dots). As a result, the driving unevenness of the photosensitive drum 303 is averaged and cancelled.

Moreover, the space between the patterns having an identical detection color (e.g., 26*b* to 26*k* in FIG. 14) is set in 140 mm (=60 mm×7/3). As a result, the driving unevenness of the driving roller 307 is averaged and cancelled.

Note that the total length Lv of the misregistration detection pattern in this case is as follows:

$$Lv=(150\times27+217\times27+300)/600\times25.4+165/600\times25.4=439.166\ [\text{mm}]$$

Note that the second term (165/600×25.4) is an allowance to prevent overlaps of the front-end patterns (26*a*, 17*a*) and the rear-end patterns (26*aa*, 27*aa*). In other words, it is clear that the conveying belt 306 must be at least 439.166 mm or more. Therefore, in a case of a small image forming apparatus where the peripheral length of the conveying belt 306 is smaller than this length, this misregistration detection pattern is not applicable.

Figure 15:
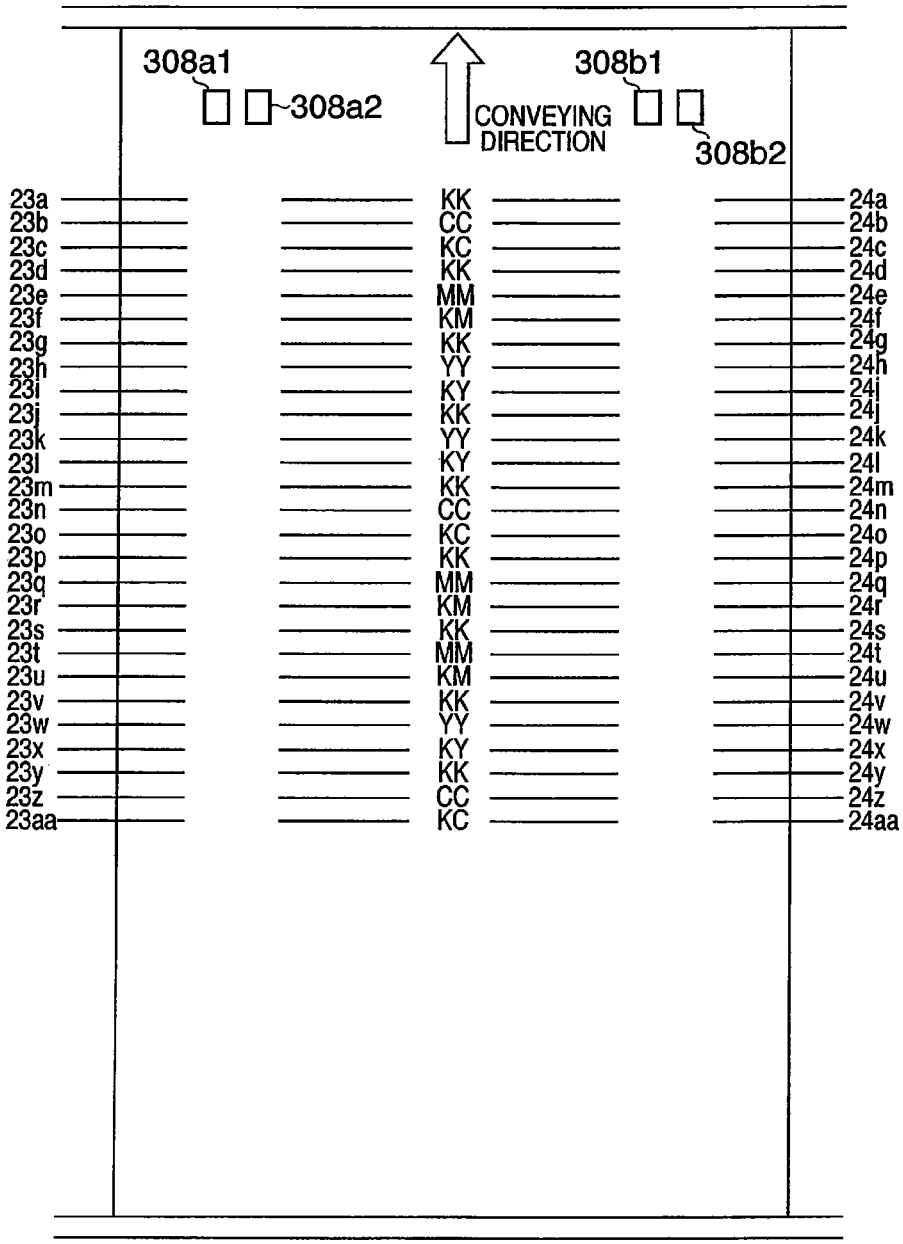
FIG. 15 is a view showing a misregistration detection pattern formed on another conveying belt.

FIG. 15 shows a misregistration detection pattern formed on another conveying belt, according to the third embodiment.

Herein, the basic patterns (=reference color patterns) (e.g., 23*a* to 23*d* in FIG. 15) are arranged at intervals of 26.67 mm (pattern width in the conveying direction: 150 dots, pattern space: 165 dots, pattern width in the scanning direction 300 dots).

Furthermore, the patterns having a detection color C are at the positions of 160 mm (=60 mm×8/3) and 320 mm (=60 mm×16/3) with 23*b* as a reference. The patterns having a detection color M are arranged at the positions of 160 mm (=60 mm×8/3) and 200 mm (=60 mm×10/3) with 23*e* as a reference. The patterns having a detection color Y are arranged at the positions of 40 mm (=60 mm×2/3) and 200 mm (=60 mm×10/3) with 23*h* as a reference. Therefore, three sets of patterns can be arranged at positions whose phases are shifted by 1/3×n cycles (n is a natural number) of the peripheral length 60 mm of the photosensitive drum 303. As a result, the driving unevenness of the photosensitive drum 303 is averaged and cancelled.

Figure 16:
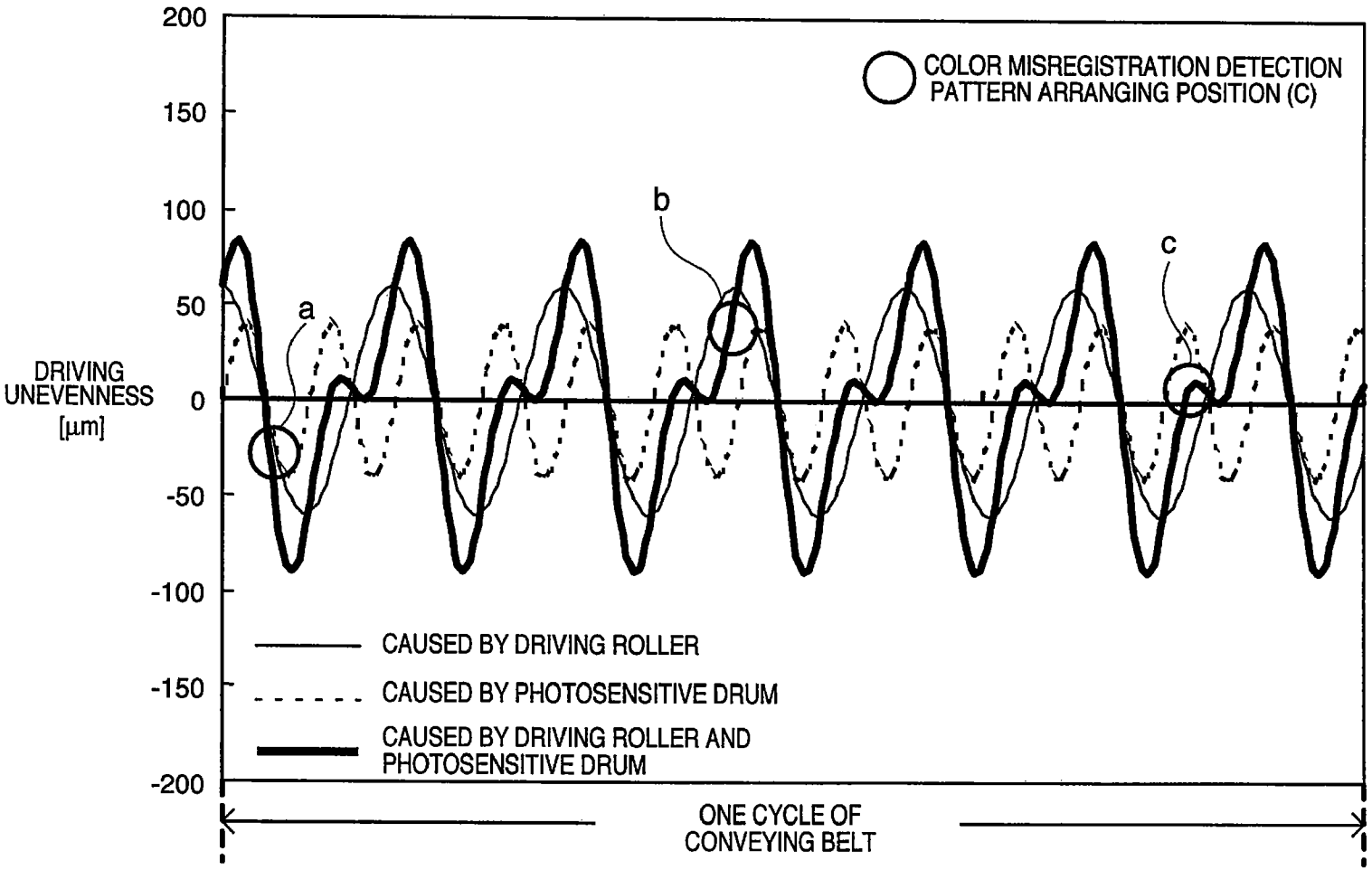
FIG. 16 is a graph showing an arrangement relation between a C pattern and driving unevenness of the image forming apparatus according to the third embodiment.

FIG. 16 shows an arrangement relation between the C pattern and driving unevenness according to the third embodiment. The curved line represented by a thick solid line indicates driving unevenness caused by the driving roller 307 and the photosensitive drum 303. The reference letters a, b and c in the drawing are positions corresponding to the C pattern. Assuming that the positions of the conveying belt driving roller and the photosensitive drum in the pattern a are the reference positions (phase 0°, the phases of the conveying belt driving roller and the photosensitive drum at the positions of patterns b and c are shown in FIG. 21. The total amount of driving unevenness L5 received by the set of C patterns (3 points) is calculated as follows:

$$L5=-39.30+37.89+1.41=0.0\ [\mu\text{m}]$$

In other words, it is clear that the driving unevenness caused by the photosensitive drum 303 and the driving roller 307 is averaged and cancelled. Also in the case of M and Y patterns, the same description can be applied.

Note that the total length Lu of the misregistration detection pattern in this case is as follows:

$$Lu=(150\times27+165\times27+300)/600\times25.4+165/600\times25.4=379.73\ [\text{mm}]$$

Note that the second term (165/600×25.4) is an allowance to prevent overlaps of the front-end patterns (23*a*, 24*a*) and the rear-end patterns (23*aa*, 24*aa*). In other words, it is clear that the total length of the detection pattern is shorter than the total length 439.166 mm of the aforementioned detection pattern. Therefore, the applicable range of this misregistration detection pattern can be extended to a small image forming apparatus where the peripheral length of the conveying belt 306 is short.

As described above, according to the present embodiment, it is possible to realize highly precise misregistration detection employing a shorter misregistration detection pattern, while suppressing increased downtime and cost.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2005-144224, filed May 17, 2005, which is hereby incorporated by reference herein in its entirety.

What is claimed is:

1. An image forming apparatus comprising:

a plurality of image forming units adapted to sequentially form images using different colors on an endless belt or on a printing material conveyed by the endless belt;

a control unit adapted to form a misregistration detection pattern on the endless belt using said image forming units; and a detection unit adapted to detect the misregistration detection pattern formed on the endless belt, wherein said misregistration detection pattern includes:

a first pattern array constructed with a plurality of serial first patterns, each formed with one of misregistration detection colors and a reference position color; and a second pattern array constructed with a plurality of serial second patterns, each formed with one of misregistration detection colors and a reference position color, wherein the first pattern array and the second pattern array are arranged along a conveying direction in which the first pattern array and the second pattern array are formed on the endless belt, and a color order of the misregistration detection colors in the first pattern array and the second pattern array arranged along the conveying direction is changed.

2. The image forming apparatus according to claim 1, wherein at least one of a length between patterns formed with the reference position color and a length between patterns formed with an identical misregistration detection color extending across the first pattern array and the second pattern array is decided based on a size of a member that causes driving unevenness.

3. The image forming apparatus according to claim 1, wherein the first pattern and the second pattern have different shapes, said first pattern array does not include a repeated pattern with respect to a color order, and a color order of the plurality of first patterns constituting said first pattern array and a color order of the plurality of second patterns constituting said second pattern array are the same.

4. The image forming apparatus according to claim 2, wherein the size of the member that causes driving unevenness is one of a peripheral length of the driving roller for driving the endless belt or a peripheral length of the photosensitive drum.

5. A control method of an image forming apparatus having a plurality of image forming units for sequentially forming images using different colors on an endless belt or on a printing material conveyed by the endless belt, comprising:

a control step of forming a misregistration detection pattern on the endless belt using the image forming units; and a detection step of detecting the misregistration detection pattern formed on the endless belt, wherein said misregistration detection pattern includes:

a first pattern array constructed with a plurality of serial first patterns, each formed with one of misregistration detection colors and a reference position color; and a second pattern array constructed with a plurality of serial second patterns, each formed with one of misregistration detection colors and a reference position color, wherein the first pattern array and the second pattern array are arranged along a conveying direction in which the first pattern array and the second pattern array are formed on the endless belt, and a color order of the misregistration detection colors in the first pattern array and the second pattern array arranged along the conveying direction is changed.

* * * * *